United States Patent [19]

Narvaez et al.

[11] Patent Number: 4,816,001

[45] Date of Patent: Mar. 28, 1989

[54] TOY FIGURE

[75] Inventors: Michael J. Narvaez, Somerville; Mary G. Narvaez, Mahwah; Christopher Cadmus, Morristown, all of N.J.

[73] Assignee: N.C.C. Toy Company, Inc., Somerville, N.J.

[21] Appl. No.: 48,260

[22] Filed: May 11, 1987

[51] Int. Cl.[4] ..... A63H 3/02

[52] U.S. Cl. ..... 446/370; 446/374

[58] Field of Search ..... 446/370, 374

[56] References Cited

U.S. PATENT DOCUMENTS

| | | | |
|---|---|---|---|
| 2,812,616 | 11/1957 | Ford | 446/374 |
| 3,210,888 | 10/1965 | Lancaster | 446/374 |
| 3,552,057 | 1/1971 | Laillevault | 446/374 |

*Primary Examiner*—Robert A. Hafer
*Assistant Examiner*—Charles H. Harris
*Attorney, Agent, or Firm*—Howard Myles Schwinger

[57] ABSTRACT

A toy figure having a body consisting of a plurality of fabric discs simulating ruffles superposed one upon the other and centrally mounted on an elastic strip, the elastic having abutments at its ends, to prevent the discs from escaping, the discs acting as a spacer to maintain the elastic in a stretched state.

1 Claim, 1 Drawing Sheet

TOY FIGURE

This invention relates to the construction of toy figures and more particularly to the construction of a doll.

Although there have been many proposals for the construction of toy figures it is believed that these have been lacking in one respect or another with ultimate constructions having yet to be set forth.

For example, in U.S. Pat. No. 3,552,057 issued to Laillevault on Jan. 5, 1971, the supporting framework requires three members and additionally, requires sewing.

It is thus a primary object of the present invention to provide a simple and inexpensive construction for a toy figure, particularly a doll intended for little girls.

It is yet another object of the present invention to provide a two piece supporting framework for a doll.

It is yet another important object of the present invention to provide a supporting framework for a doll which does not require sewing.

It is another important object of the present invention to provide a construction for a toy figure which cannot possibly injure or be dangerous to the child who plays with it.

It is still another object of the invention to provide a doll which is most pleasing to children.

Other objects and advantages of the present invention will become apparent from a reading of the following Specification taken in conjunction with the attached Drawing wherein.

Figure 1:
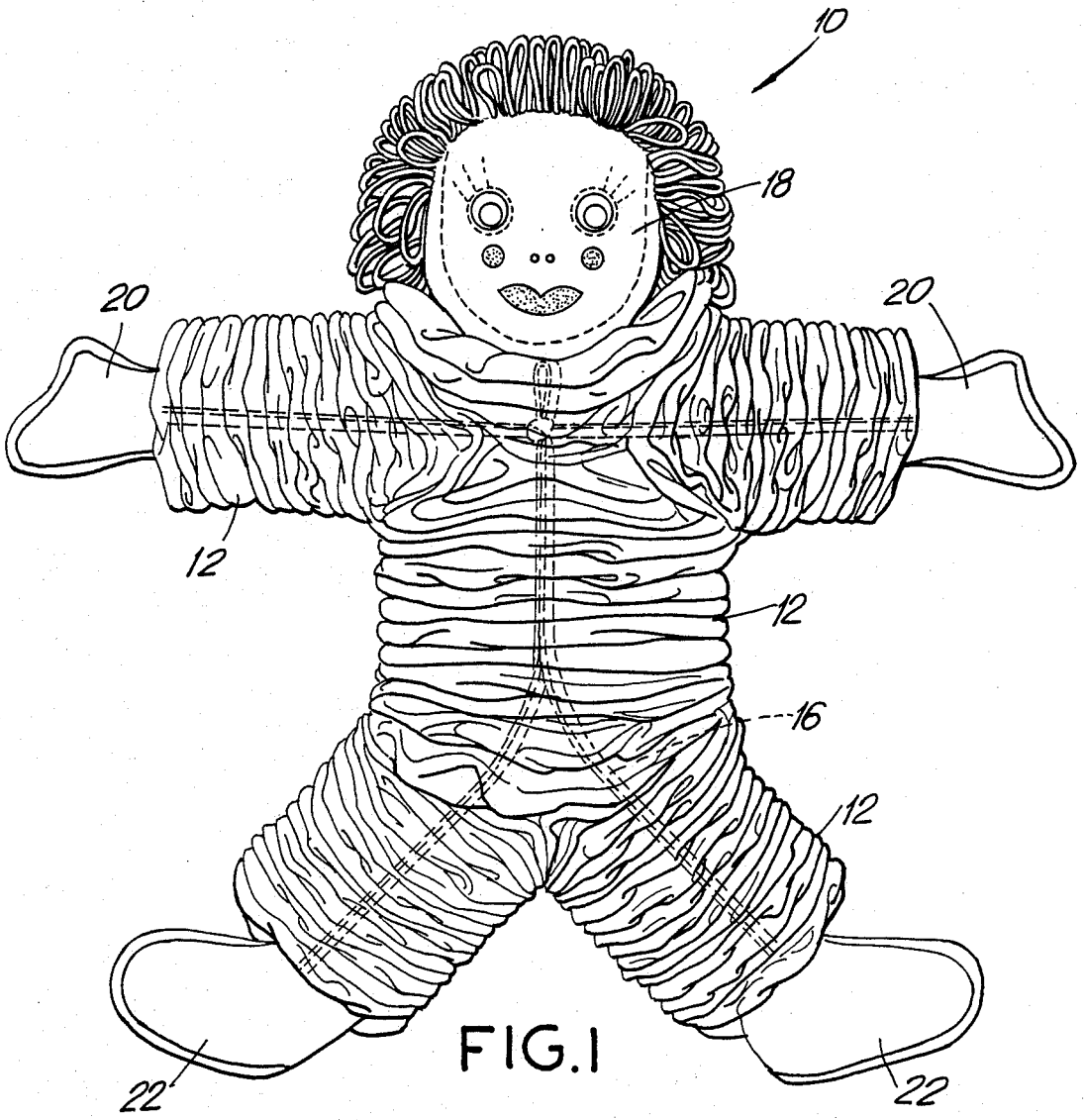
FIG. 1 is a perspective view of an embodiment of doll in accordance with the present invention with certain internal detail being shown in phantom.
Figure 3:
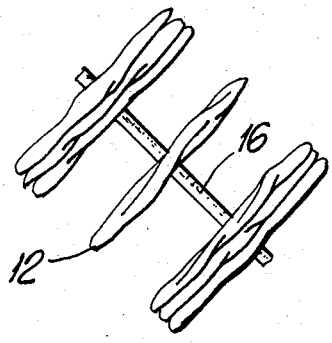
FIG. 3 is an enlargement of the elastic when pulled taut to show the disparate nature of the ruffles.

A doll in accordance with the present invention is indicated by numeral 10 in the drawing. The body of the doll is made up of a plurality of discrete fabric ruffles 12 superposed one upon the other. As will be readily appreciated, the ruffles are tightly packed to give the doll "body".

Ruffles 12 are centrally apertured at 14 so as to be threadable on elastic 16. Thus the ruffles or fabric discs are supported by the elastic which is stretched taut by the large number of discs supported thereby. This effect is achieved by attaching the ends of the elastic to the head 18, arms 20 and feet 22 of the doll and using these parts as stops or abutments to prevent the discs from escaping the assemblage.

Figure 2:
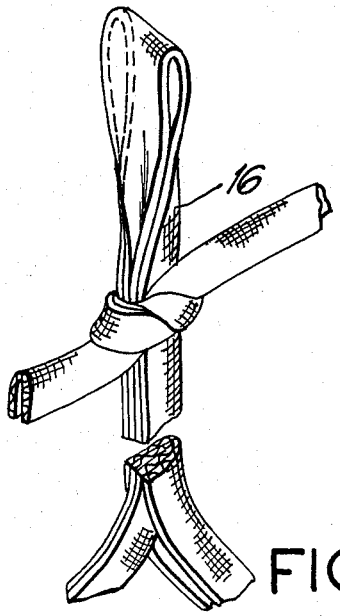
FIG. 2 is an enlargement showing the arrangement of the elastic of FIG. 1 in detail.

It will be thus realized that elastic 16 is arranged to have five ends; two for the hands, two for the feet and one for the head. As will be seen in FIG. 2 this is accomplished by uniting two separate lengths of elastic by tying to yield two attached lengths positioned perpendicularly to one another when extended. The normally horizontal length will go to form the arms with hands being attached at its ends to act as abutments for the discs 14.

It will be seen that the normally vertical elastic component is a piece which has been doubled upon itself to present a loop at one end. It is to this end that the head is attached. The vertical component is held together in this doubled fashion by the discs making up the torso of the doll. The elastic, however, splits at the legs with one component extending into the right leg and the other component extending into the left.

The diameter of the circular discs varies being greatest at the torso and smallest at the arms. For a doll having an overall height of about a foot and a half a total of twenty doubled ruffles may be employed to form the torso with twenty doubled ruffles being utilized for each extremity. The ruffles may be multi-colored to enhance the appearance of the doll.

Figure 4:
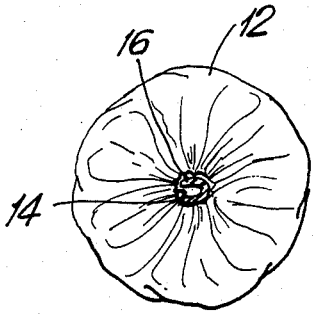
FIG. 4 is a view of the underside of one of the fabric ruffles.

In this embodiment of the invention, each ruffle is made from a single piece of fabric cut in such a fashion so that when it is folded upon itself the result is circular. This may be best seen in FIG. 4.

It should be realized that the embodiment herein described is only representative of the invention and it is not intended to limit the invention to this particular embodiment as the invention encompasses all embodiments falling with the spirit and scope of the appended claims.

We claim:

1. A toy figure having (having body parts designed to simulate a figure) a head, torso, arms and legs and hands and feet comprising a plurality of double layered fabric discs simulating ruffles superposed one upon the other, two lengths of elastic, one length extending across the (chest) torso of the figure to the ends of the (forelimbs) arms, the other length extending from the head to the ends of the (hindlimbs) legs, the latter section being doubled so as to be separable into two pieces at the (hindlimbs) legs, all providing a simplified two piece skeletal structure, the elastic extending across the (chest) torso being knotted to the other elastic piece eliminating the need for sewing, the discs being centrally apertured to permit the elastic to be threaded therethrough, abutments affixed to the ends of the elastic to block the discs from escaping the elastic, the abutments assuming the appearance of (terminal body parts) hands and feet, the discs acting as a spacer to maintain the elastic in a stretched state.

* * * * *